US006209819B1

(12) United States Patent
Habisreitinger et al.

(10) Patent No.: US 6,209,819 B1
(45) Date of Patent: Apr. 3, 2001

(54) DEVICE AND METHOD FOR AUTOMATIC CHANGING OF FILM ROLLS

(75) Inventors: Uwe Habisreitinger, Freudenstadt; Bernhard Nordmann, Boeblingen; Wolfram Walter, Neuhausen, all of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/262,834

(22) Filed: Mar. 5, 1999

(30) Foreign Application Priority Data

Mar. 5, 1998 (DE) ..... 198 09 516

(51) Int. Cl.[7] ..... B65H 19/00

(52) U.S. Cl. ..... 242/559.3; 242/558; 242/559; 242/560; 242/562; 242/563.2; 242/595.1; 242/596.4; 242/553; 414/911

(58) Field of Search ..... 242/559.3, 558, 242/559, 560, 562, 563.2, 578, 595.1, 596.4, 553, 554.1, 556, 556.1; 414/911, 908, 745.9, 746.5, 331.14

(56) References Cited

U.S. PATENT DOCUMENTS 2,218,499 * 10/1940 Wood ..... 242/559
2,508,566 * 5/1950 Dunton ..... 242/559.3
3,974,490 * 8/1976 Mori ..... 242/563.2 X
3,991,951 * 11/1976 Galletti ..... 242/559.3
4,021,002 * 5/1977 Meihofer ..... 242/563.2
4,693,433 * 9/1987 Martin ..... 2421/559 X
4,913,366 * 4/1990 Andou ..... 242/563.2
5,004,174 * 4/1991 Deutschle ..... 242/595.1 X
5,333,803 * 8/1994 Planeta ..... 242/560 X
5,478,027 * 12/1995 Alexander, III ..... 242/558

FOREIGN PATENT DOCUMENTS

4147715 * 5/1992 (JP) ..... 242/559.3

* cited by examiner

*Primary Examiner*—Donald P. Walsh
*Assistant Examiner*—Minh-Chau Pham
(74) *Attorney, Agent, or Firm*—Evenson, McKeown, Edwards & Lenahan, P.L.L.C.

(57) ABSTRACT

Device and method for changing film rolls, with apparatus for holding a first film roll in a working position in which film can be pulled off and separated from the film roll as desired, and holding a second film roll in a standby position. The second film roll can be moved from the standby position into the working position, with the first film roll being removable from the working position by moving the second film roll.

17 Claims, 11 Drawing Sheets

DEVICE AND METHOD FOR AUTOMATIC CHANGING OF FILM ROLLS

BACKGROUND AND SUMMARY OF THE INVENTION

This application claims the priority of German patent application 198 09 516.3, filed Mar. 5, 1998, the disclosure of which is expressly incorporated by reference herein.

The present invention relates to a method and apparatus for automatically changing rolls of self adhesive protective film.

In the mass production of motor vehicles, the vehicles must be prepared for shipment so that they do not suffer any damage, especially so that paint is not adversely affected by shipment and weathering influences. If shipment by rail or ship is required for transport to the customer, it has been conventional heretofore to coat vehicles with a protective layer of wax which must be removed before delivery to the customer. Removing the protective wax without leaving any residue was not only a labor-intensive task but also imposed burdens on both people and the environment because of the solvents used. Therefore, a change has recently been made to protecting bodies during shipment by using self-adhesive films.

Such films are usually pulled manually from a film roll and applied to the parts to be protected. It is also known to mount film rolls in a holder and to pull the film off under machine control. Replacement of such film rolls has proven to be very labor-intensive. For example, the remaining film supply must be constantly monitored so that the film roll can be replaced when its end is reached. The used film roll must then be removed and replaced by a new film roll. Since the new film roll is usually not stored in the immediate vicinity of a film application device, this results either in prolonged production interruptions or a need for an operator constantly to monitor the film roll as it unrolls so that preparation for replacement can begin shortly before the end of the film roll.

Hence, one object of the invention is to provide a method and apparatus for automatically changing film rolls, in which the replacement of film rolls is less awkward by comparison with the prior art, so that production interruptions can be avoided. Another object of the invention is to eliminate the need for extra personnel to monitor the production process with regard to the changing of film rolls.

Still another object of the invention is to provide a method and apparatus by which, all of the film roll changers can be loaded at any desired point in time in order thus to ensure that the film length is sufficient for an entire shift for example.

These and other objects and advantages are achieved by the method and apparatus according to the invention, in which simple automatic changing of film rolls is possible without production interruptions, by moving a replacement roll (second film roll), which is stored in a standby position in the device, into a working position, in which film can be pulled from a film roll (first film roll). By a suitable choice of film roll sizes it is possible to perform an adjustment to a film length that is required for example during a shift.

Since it was conventionally possible to provide a replacement roll only immediately when a film roll ran out or reached the end or to load it into the changing device, the device according to the invention represents a considerable simplification. An operator can, within certain time limits, load the device according to the invention with another film roll at any time without adversely affecting the production process in any way. The loading process can be performed during a shift or between two shifts for example or during the unsticking process. Furthermore, the film roll can be changed in a very simple fashion essentially by means of a single traveling movement of a replacement roll, since a used film roll can be removed from the working position by moving the replacement roll and then bringing the replacement roll into the working position.

According to one preferred embodiment of the invention, the device has an ejection device with means for holding or moving the second film roll, by means of which the first film roll can be removed from the working position during the movement of the second film roll. This makes it possible to change a film roll in an especially simple and mechanically reliable fashion.

Advantageously, the device according to the invention has a lifting device for essentially vertical movement of a pallet on which the second film roll can be placed, especially on rotatable support rollers. By means of such a lifting device, the second film roll can be brought into the working position in a simple fashion. Furthermore, the rotatable support rollers facilitate pulling off the end of the film for sticking it to a locking tube, described below.

Advantageously, the device has a pivotable ejection loop that is connected with the pallet for removing the first film roll from the working position as the second film roll moves vertically. Such an ejection loop can remove a film roll to be replaced from its holder in simple fashion during the upward lifting movement of the pallet, and the loop can be guided past a new film roll held in the working position during a subsequent downward movement because of its ability to pivot.

According to one preferred embodiment, the pallet can be positioned on a carriage which can be introduced into a frame of the device in such fashion that the second film roll located on the pallet can be brought into the standby position. A carriage of this type makes it possible in simple fashion to introduce a new film roll into the device at any point in time during the operation of the device, such as during the pulling of the film from the first film roll, without adversely affecting operation in any way whatever. The carriage can have a plurality of rollers that can be made rotatable depending on the space conditions. As a result, movement of the carriage between a film roll storage area and the device for changing film rolls can be accomplished in simple fashion.

Advantageously, at least two centering pins are provided to secure the pallet in position on the carriage. With such centering pins, the pallet can be suitably positioned on the carriage that can be introduced into the device.

According to one preferred embodiment, the device has a compensating roller that is drivable and/or brakable and can be brought into an operating connection with the first film roll. By means of such a compensating roller, when the film is pulled off the film roll, its pulling edge can be secured in simple fashion, with the pulling off of the film being supported if necessary by a corresponding rotary movement of the compensating roller. Furthermore, the roll can advantageously also be drivable in the opposite direction so that film that has been pulled off can be rewound by means of the compensating roller. The ability to brake the film roll ensures a defined pulling off of the film.

Advantageously, the device also has a measuring means that can be brought into an operating connection with the first film roll, especially a measuring wheel for measuring the film pulled off the film roll, and with signal generating means cooperating with the measuring means to output a signal to a control device on the means for triggering the lifting or movement of the second film roll. As a result, in simple fashion, it is possible to determine the length of the film pulled off the film roll that is in the working position. When the end of the film is reached, it is then possible to replace the old film roll by a new film roll. The measuring wheel can generate a signal suitable for this purpose and send it to control means or transmit it directly to the lifting device.

According to one preferred embodiment, a locking tube is mounted on the lifting device or the pallet, to which tube the beginning of the film pulled off the second roll can be secured. As a result, the end of the film that has been pulled off the second film roll can be secured in simple fashion so that after the second film roll moves into the working position, further pulling off of the film is simplified.

Advantageously, the device according to the invention has a suction strip by means of which the film end of the second film roll secured to the fixing tube, when the working position is reached, can be secured further in preparation for pulling off the film as provided.

Advantageously, a cutting device is provided for cutting the film between the locking tube and the suction strip. As a result, the end of the film on the second film roll can be separated in simple fashion from the locking tube so that the tube, together with the pallet or the lifting device, can be lowered again.

According to one preferred embodiment of the method according to the invention, when the signal indicating the end of the film on the first film roll is generated, before or during the lifting or movement of the second film roll, the film that has already been pulled off the first film roll and not yet cut is rewound on the film roll. As a result, the first film roll can be removed subsequently from the working position in a very simple fashion.

Other objects, advantages and novel features of the present invention will become apparent from the following detailed description of the invention when considered in conjunction with the accompanying drawings.

DETAILED DESCRIPTION OF THE DRAWINGS

Figure 4:
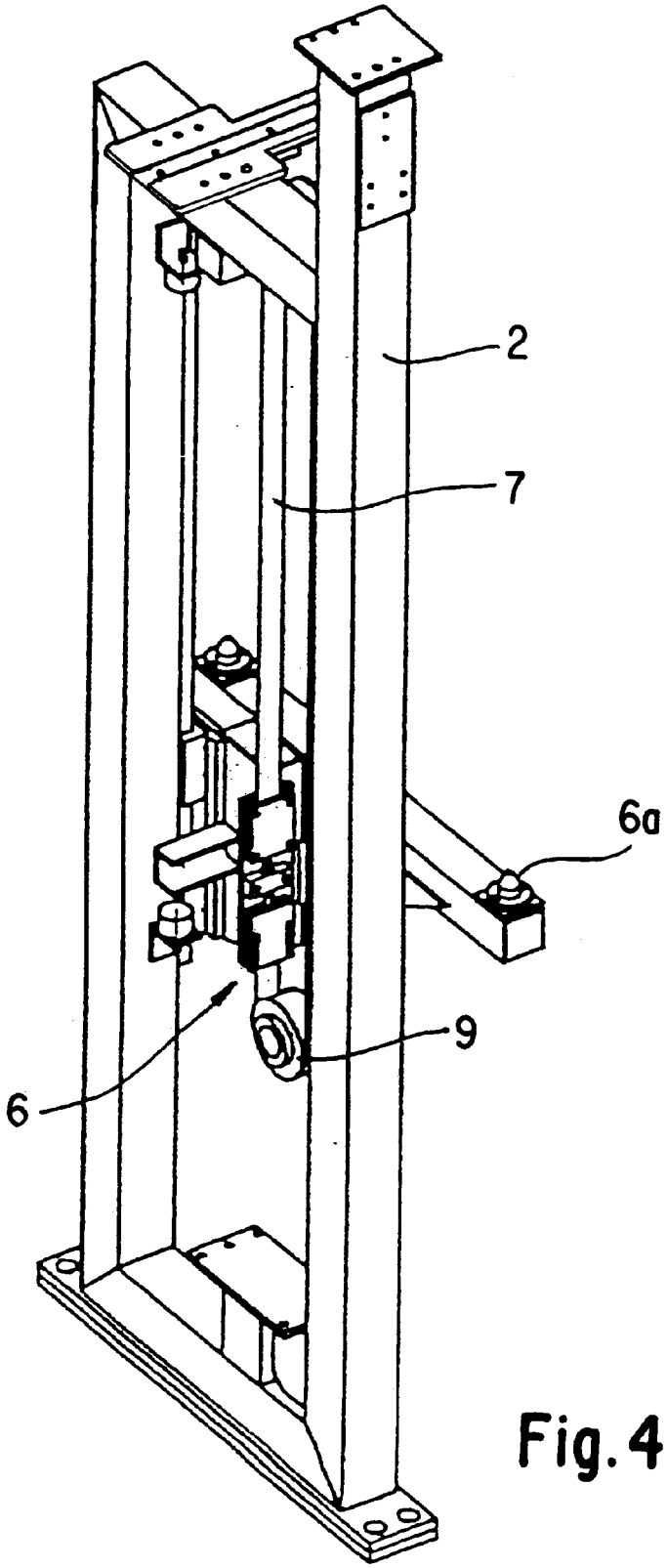
FIG. 4 is a perspective view of a lifting device used according to the invention.
Figure 5:
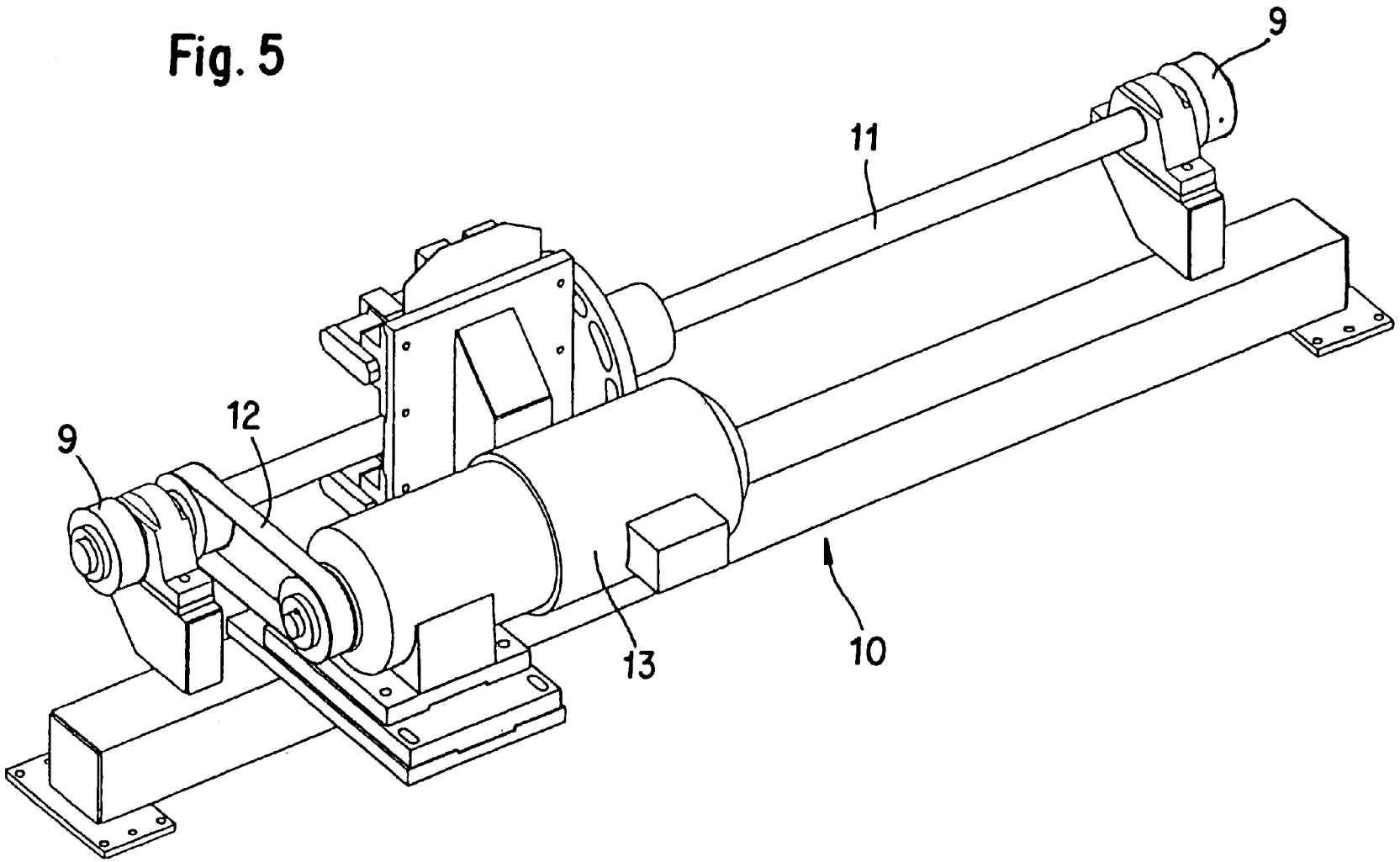
FIG. 5 is a drive unit used according to the invention for actuating the lifting device.

The device according to the invention has a frame 1 with a left frame part 2 and a right frame part 3 connected to one another by cross struts 4 and 5 (FIGS. 1 to 3) which are aligned with the width of the film rolls to be processed and/or used. A lifting device 6 is provided on each of the two frame parts 2 and 3 (see also FIG. 4). Each lifting device has an endless belt 7 guided around two reversing rollers 8 and 9. The lower reversing rollers 9 of the lifting devices 6 are secured to the ends of a driven shaft 11 of drive unit 10, and can be driven by the drive unit 10 (FIG. 5). Shaft 11 is driven by means of an endless belt 12 by an electric motor 13 (FIG. 5). To prevent an undesired lowering of the lifting devices 6, for example in the event of a power failure, it is possible to design the drive unit with a locking disk.

A pallet 14 holding a film roll 15 can be raised and lowered by means of lifting devices 6. As a result it is possible to move the film roll 15 between a standby position S and a working position W provided in the upper part of the frame, in which the film is pulled off the film roll for use as provided. To secure the pallet 14 on lifting devices 6, the devices are equipped with locking and/or centering pins 6*a* or support plates 6*b*. (FIG. 1).

Figure 1:
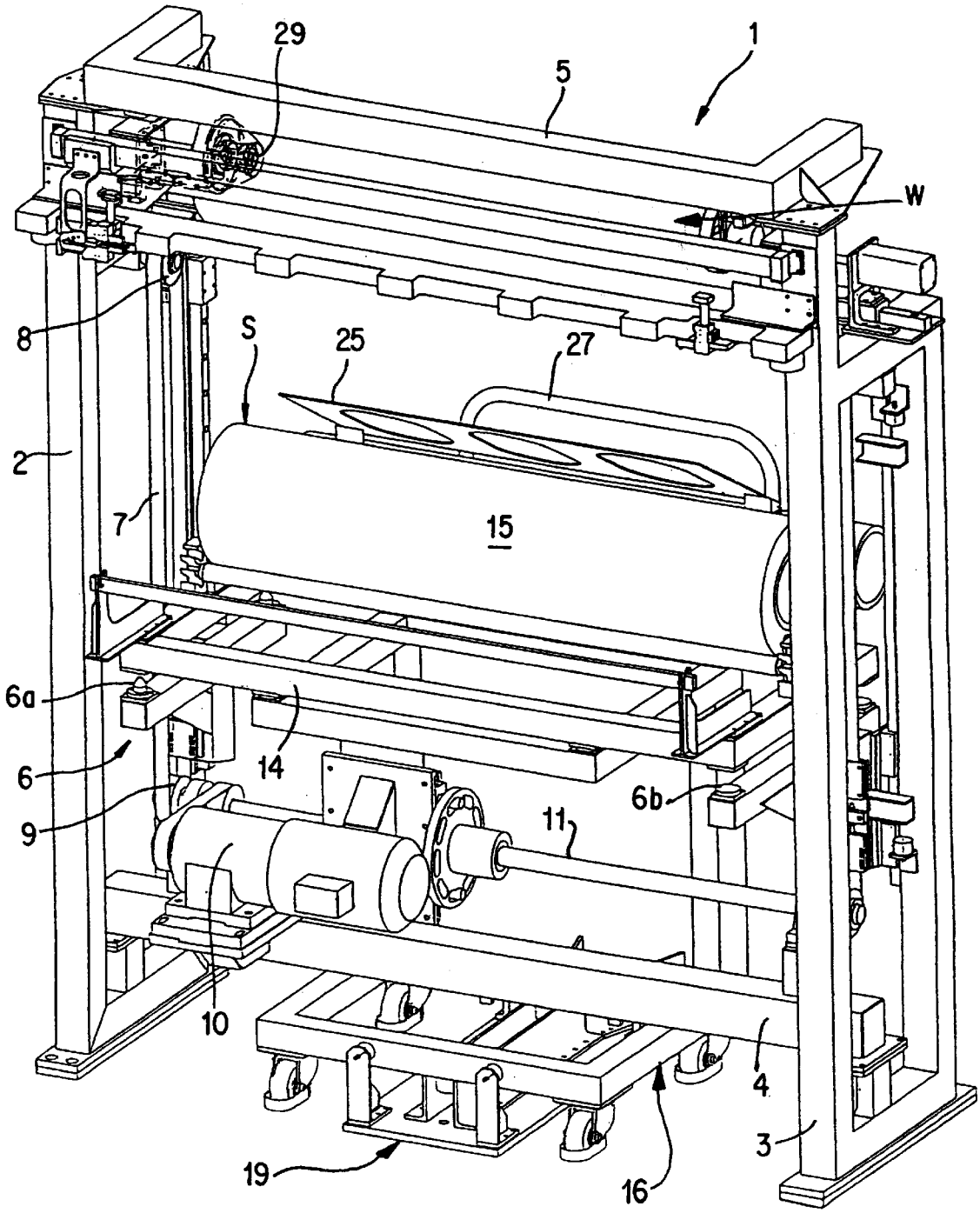
FIG. 1 is a perspective front view of the device according to the invention.
Figure 9:
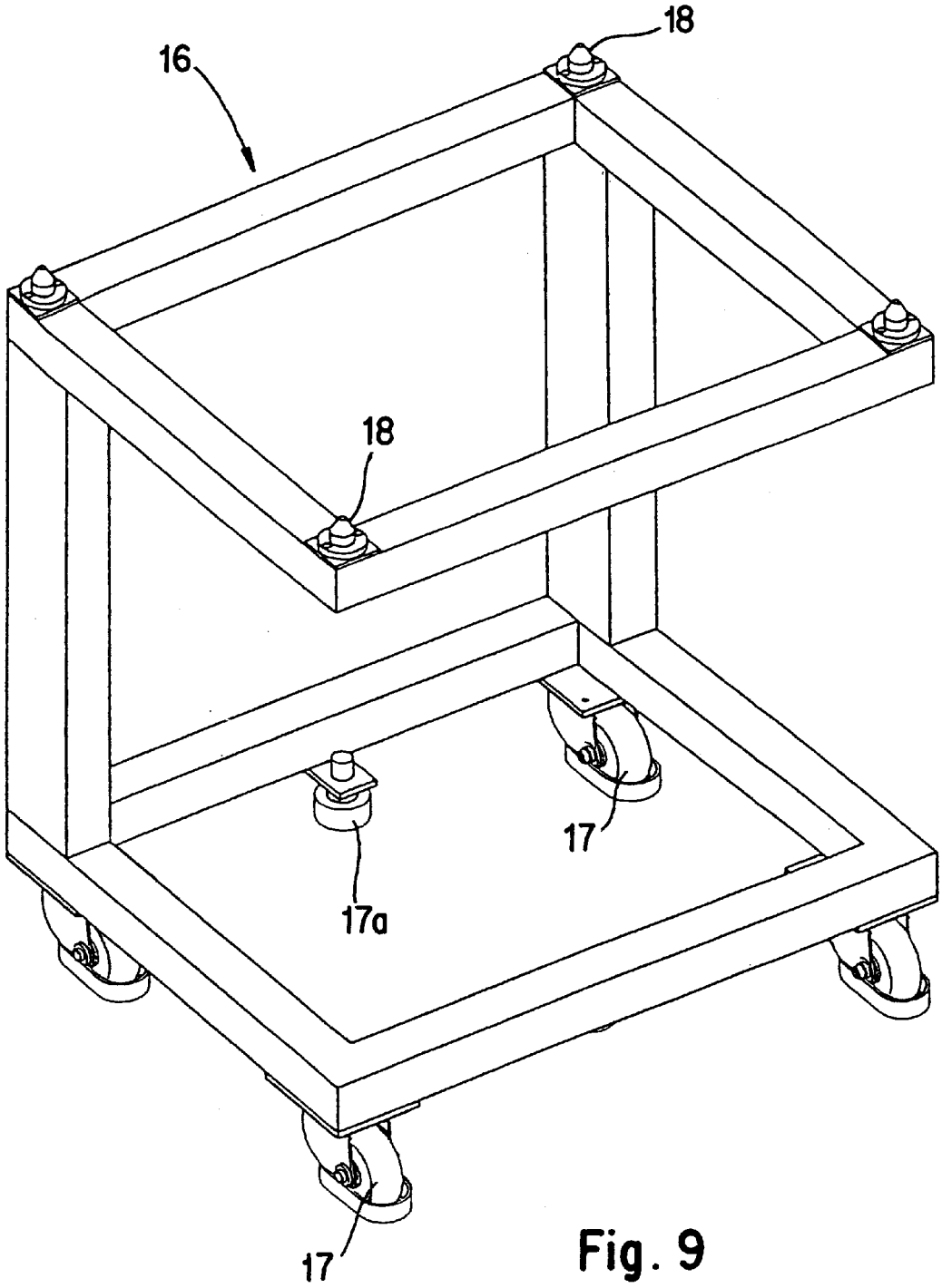
FIG. 9 is a perspective view of a carriage used in the device according to the invention.
Figure 10:
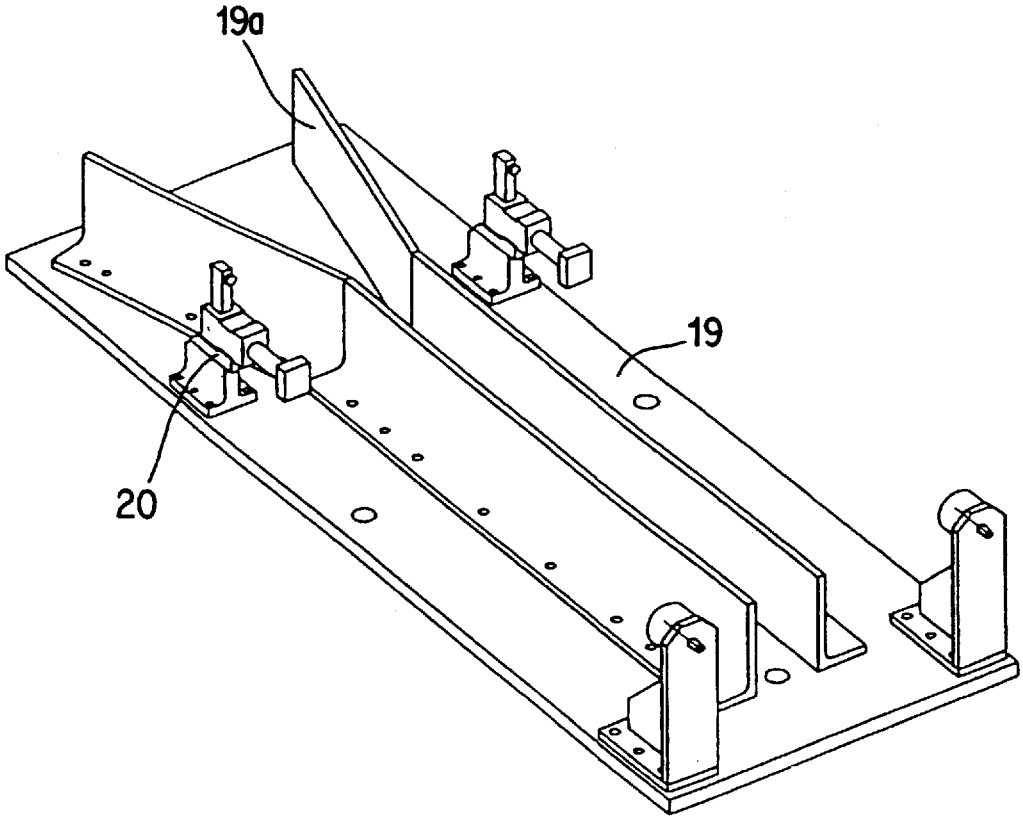
FIG. 10 is a perspective view of a carriage guide used in the device according to the invention.

To introduce the pallet 14 supporting the film roll 15 into the frame 1, the pallet can be placed initially on a carriage 16 (FIG. 9) that can be pushed into the lower part of frame 1 as shown in FIG. 1. Carriage 16 travels on four rollers 17, which can be made rotatable depending on the space available. The reception and/or holding of pallet 14 on carriage 16 is accomplished by means of least two centering pins 18 by which tolerances can be compensated in simple fashion. For exact introduction or positioning of carriage 16 in the lower part of frame 1, a carriage guide 19 is provided that is fastened to the floor beneath frame 1 (FIGS. 1 and 10). The positioning is accomplished by means of curved rollers 17*a* provided on the carriage, which can be introduced into a tapering guide channel 19*a* of the carriage guide 19. By positioning the carriage 16 in the carriage guide 19, the pallet can be brought into a removal position or the film roll 15 can be brought into the standby position S from which lifting device 6 raises the pallet. Carriage 16 is locked in carriage guide 19 by clamps 20 for example (FIG. 10).

Figure 11:
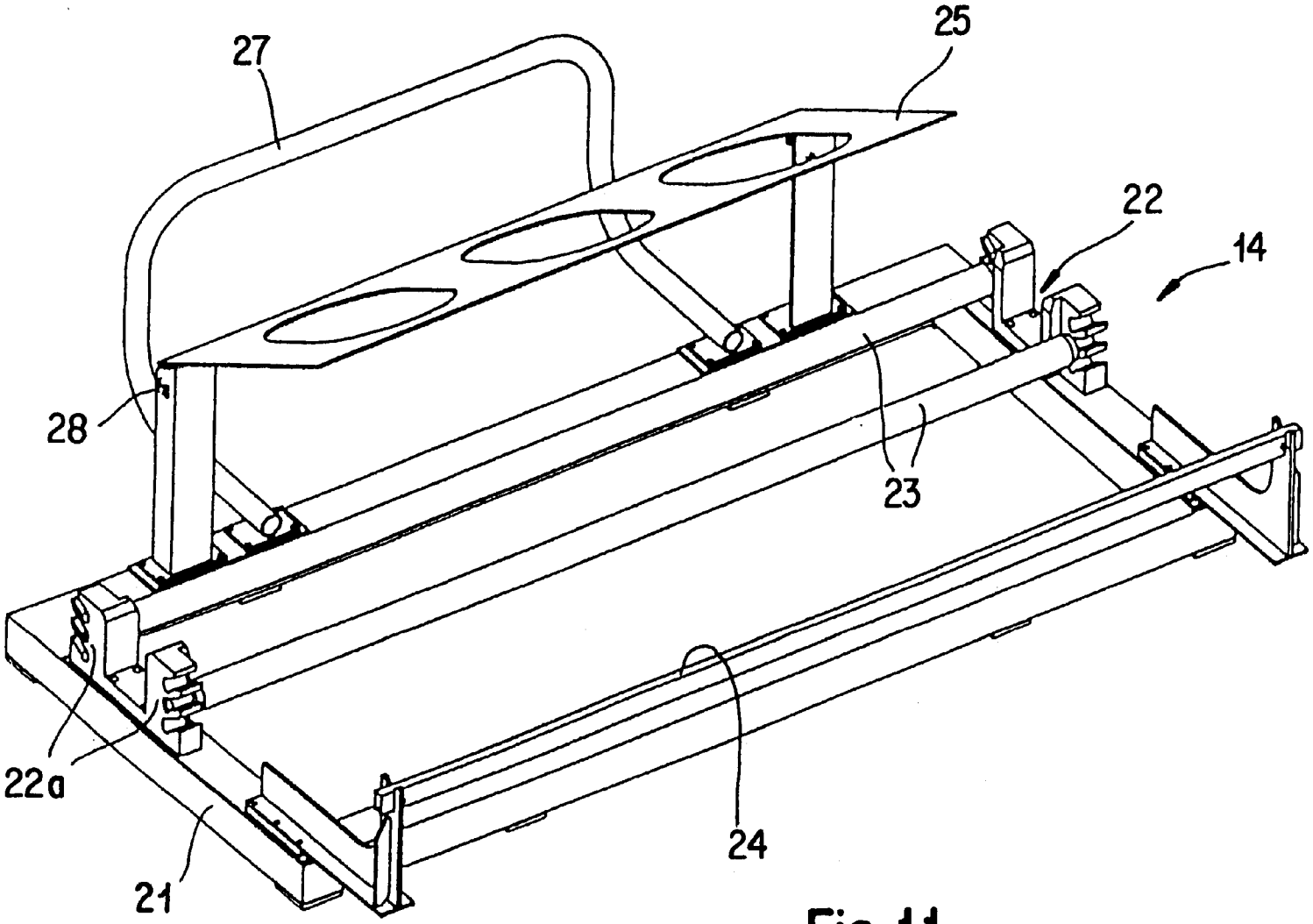
FIG. 11 is a perspective view of a pallet used in the device according to the invention.

Pallet 14 that can be placed on carriage 16 is shown in detail in FIG. 11, and consists of frame 21 on which a receiving mount 22 for the film roll 15 is mounted. The film roll is then placed on two rotating rollers 23 of receiving mount 22 that can be introduced into matching receptacles 22*a*. As a result, for example, the end of the film can be pulled off in simple fashion in preparation. To lock the end of the film and to make it accessible, after being pulled off film roll 15 the film end can be secured or glued to a locking tube 24 provided on pallet 14, said tube preferably having a rectangular cross section. A possible variable outside diameter of film roll 15 (in practice between 250 and 350 mm) can be accommodated by different insertion heights of rotary rollers 23. This is accomplished in simple fashion by choosing appropriate recesses 22*a*. As a result, film rolls 15 from different manufacturers can be used for example. Pallet 14 also has an ejection loop 25 by means of which a film roll 26 that is in the working position of the device, after use, can be ejected into a cardboard core receptacle 27 as explained below. Ejection loop 25 can be pivoted upward around an axis 28, as shown in the diagram in FIG. 11 for example.

Figure 6:
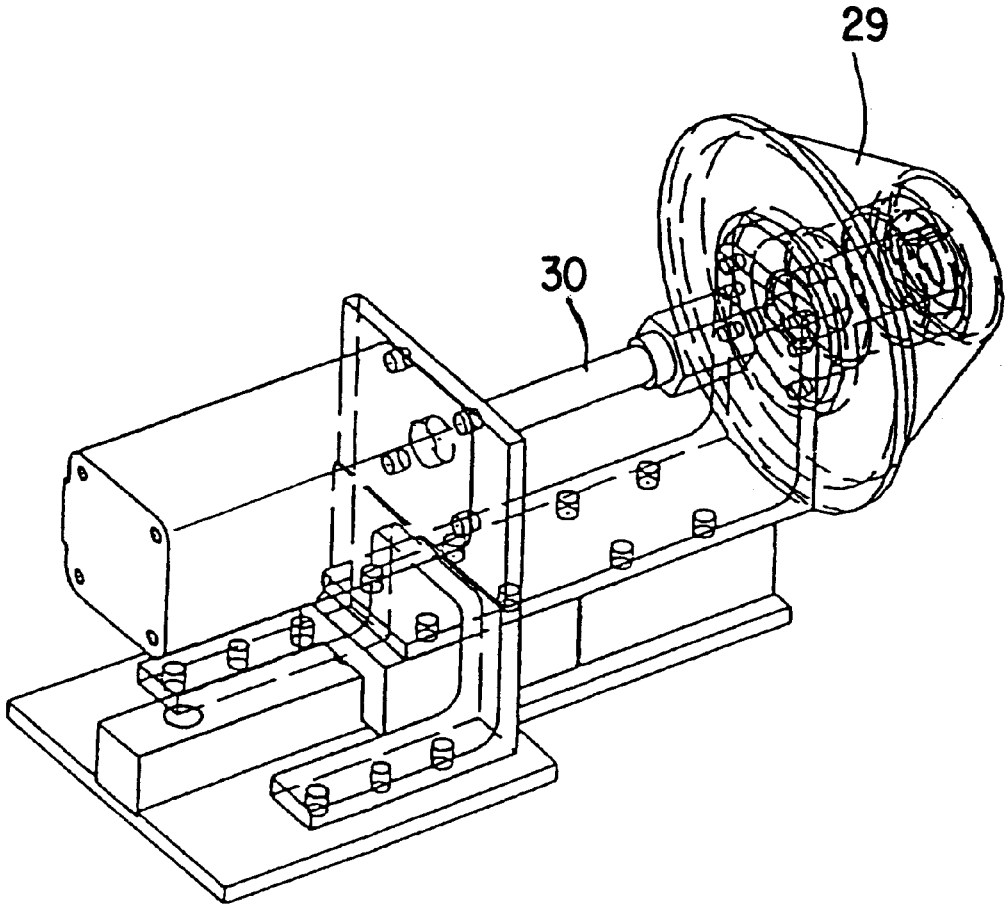
FIG. 6 is a film roll lock used in the device according to the invention, in a perspective view.

The means for locking film roll 26 in the working position W of the device are shown in detail in FIG. 6. The film roll is locked in working position W, on both sides by means of a conical receptacle 29 on each side. Conical receptacles 29 can be moved separately by cylinders 30; that is, they can be moved away from film roll 26 or toward it. Film roll 26 can be aligned in working position W for example by one of the two cylinders 30 that serves as the determining cylinder. As a result of differences in pressure on the left and right, the determining cylinder 30 is fully extended so that film roll 26 can be aligned in the desired fashion.

Figure 2:
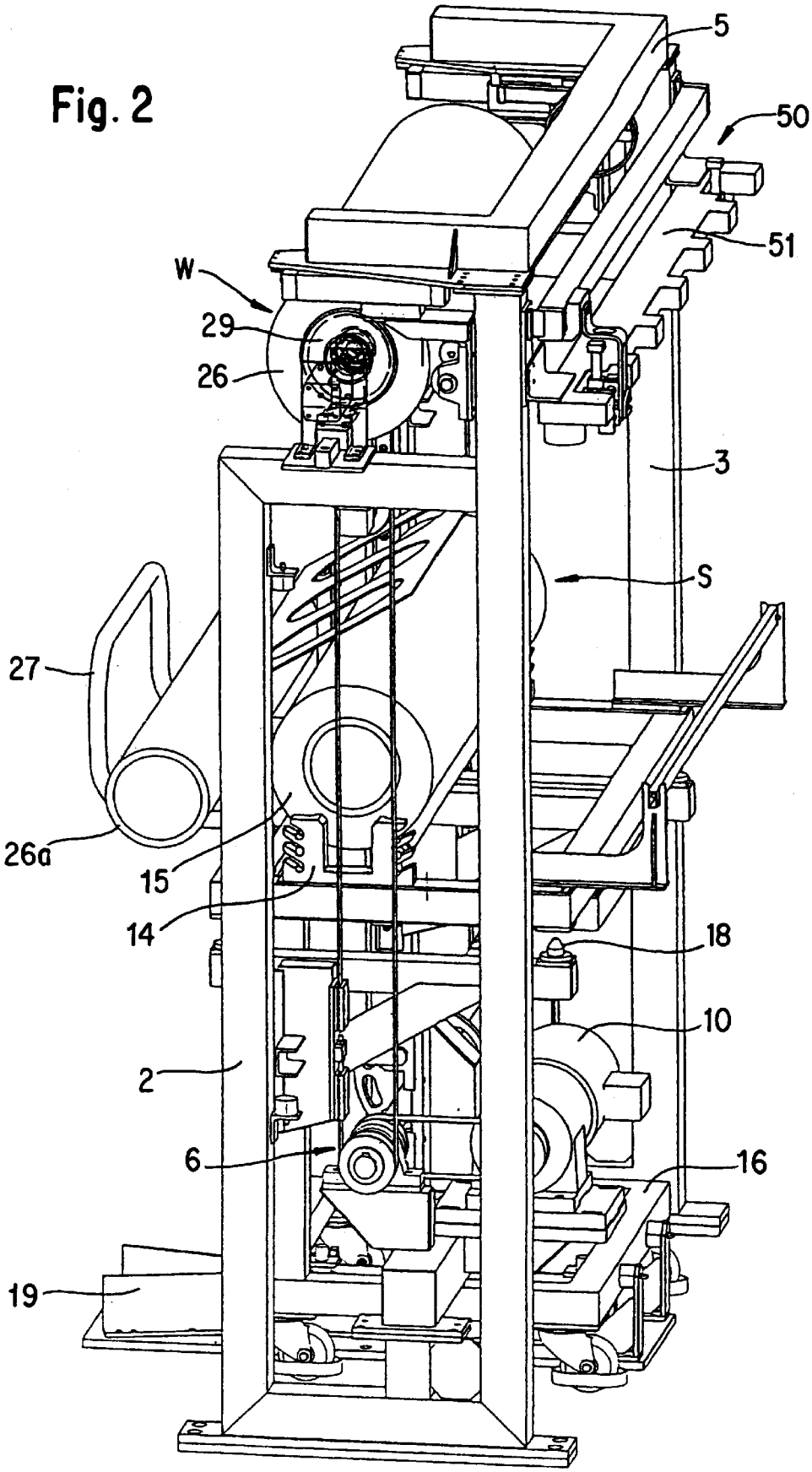
FIG. 2 is a perspective, essentially lateral view of the device according to the invention.
Figure 3:
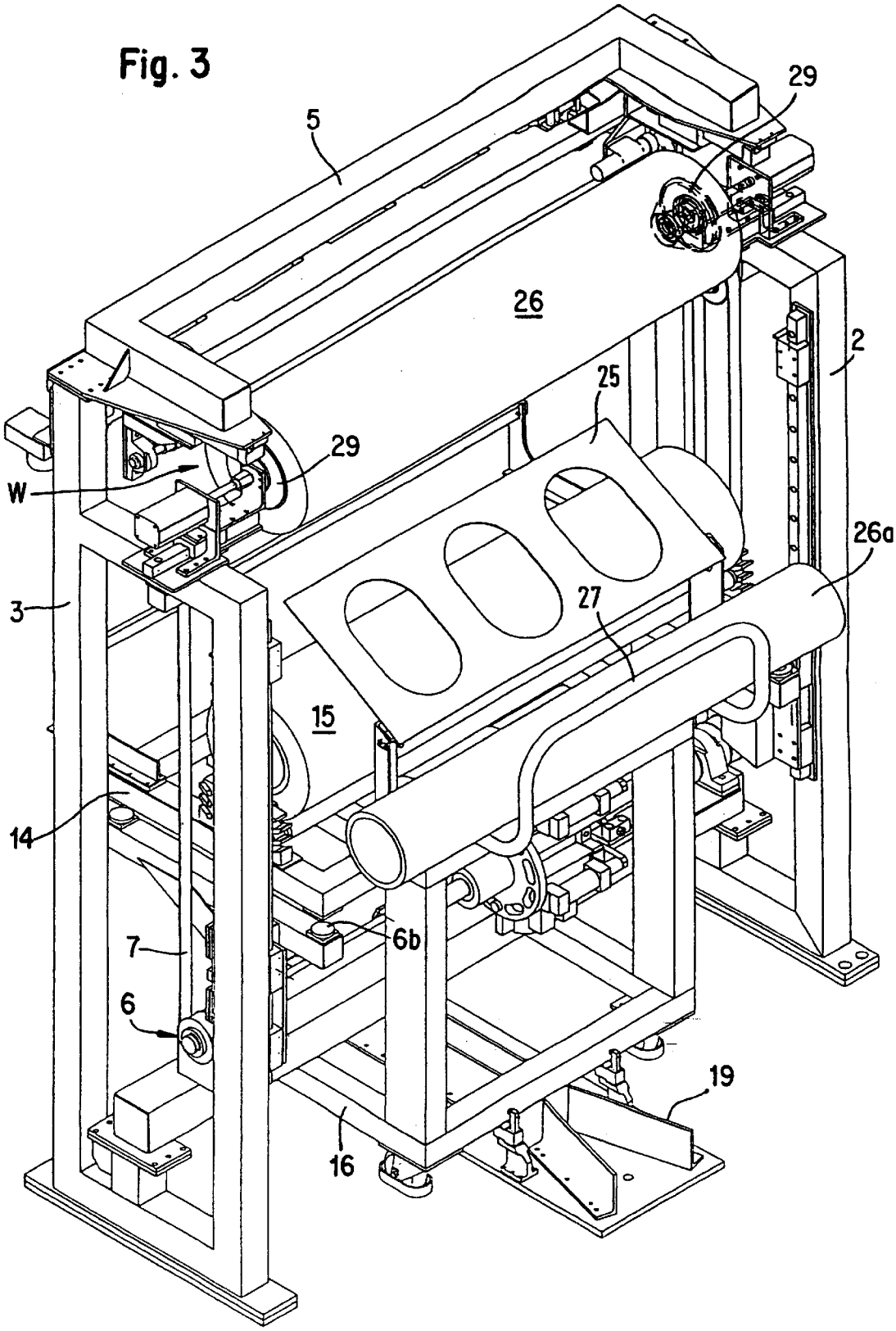
FIG. 3 is a perspective rear view of the device according to the invention.

At this point, especially with reference to FIGS. 1–3, the operation of the device shown for transporting and/or lifting film rolls 15 from the standby position into the working position in which they are held by conical receptacles 29 will be described. In the operating state shown in FIGS. 2 and 3, the first film roll 26 is in the working position W, secured by the conical receptacles or clamping mandrels 29, and a second film roll 15 is then in its standby position S on pallet 14, which still rests on carriage 16. A roll core 26*a*, which was removed at an earlier point in time from working position W lies in a cardboard core holder 27. By means of their locking pins 6*a* and support plates 6*b*, the respective lifting devices 6, upon actuation of drive unit 10, engage matching recesses and engagement surfaces in the underside of frame 21 of pallet 14. (See FIG. 1.)

By means of lifting devices 6, pallet 14 is then lifted from the carriage and moved upward. Ejection loop 25 initially comes in contact with the film roll 26 that is in the working position or with its core. Shortly before the ejection loop 25 comes in contact with the film roll 26, the conical receptacles or clamping mandrels 29 that held film roll 26 during the film unrolling process are opened. When pallet 14 travels further upward, the film roll 26 is contacted by ejection loop 25 and falls backward into the cardboard core receptacle 27 as indicated in the drawing of the roll core 26*a*. Further lifting of the pallet 14 brings the film roll 15 mounted on the pallet 14 into the working position and it can be secured there by means of the conical receptacles 29. By means of a single lifting movement it is therefore possible to remove the used film roll 26 and replace it by a new film roll 15. As explained below, it is also possible at the same time to cut the end of the film from the locking tube 24. Then the pallet 14 can be lowered again in the same way, with the ejection loop 25, by pivoting around axis 28, being capable of being carried past the new film roll 15 that is now in the working position.

Figure 7:
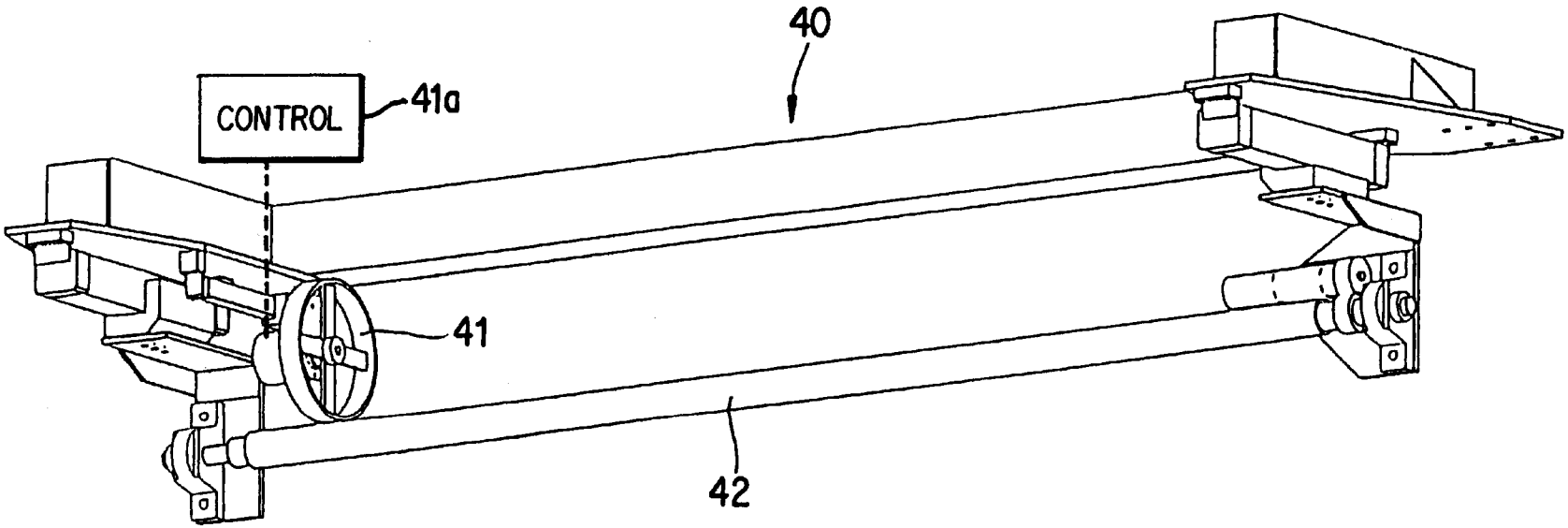
FIG. 7 is a perspective view of the unrolling unit used in the device according to the invention.

The unrolling unit 40 shown in FIG. 7 will now be described in detail, which permits a defined pulling of the film off the film roll 26 in the working position. The unrolling unit 40 is located in the upper part of frame 1 in the vicinity of cross strut 5. It has measuring means with a measuring wheel 41 and an electronic counter. The measuring means are in an operating connection with the film roll that is in the working position and they determine the length of the film that has been pulled off, and when the film has been pulled out correspondingly far, 800 meters for example, they trigger the automatic film roll change described. For example, a signal that can be generated by the measuring means can be transmitted to a control device 41*a* of the device. Unrolling unit 40 also has a compensating roller 42. This roller can be driven by a motor, for example a pneumatic motor or electric motor. When the film is pulled off the film roll 26 that is in the working position, the motor is used as a brake for compensating roller 42. The braking torque can be chosen to be fixed or variable. It should be pointed out that as an alternative, shoe brakes, disc brakes, or eddy current brakes can be used. By an appropriate adjustment of the compensating roller 42, the pull-off point or the pull-off edge of film that is on film roll 26 can be varied in suitable fashion. The pressure of the compensating roller on the film roll can be adjusted.

When the automatic film roll change essentially already described is triggered, the film roll removal from film roll 26 is halted first. Then the remaining film is rewound onto film roll 26. This rewind is performed by compensating roller 42 which is driven accordingly for the purpose. Then the components of unrolling unit 40 are brought out of the engagement area of lifting device 6. After the replacement process described above is completed and the new film roll has been positioned in working position W, components 41, 42 of unrolling unit 40 are again brought into an operating connection with the new film roll. The unrolling unit can be equipped with a device to discharge any static that collects on the film. For this purpose, a combination of a fixed upper strip and a pivotable lower strip is possible.

Figure 8:
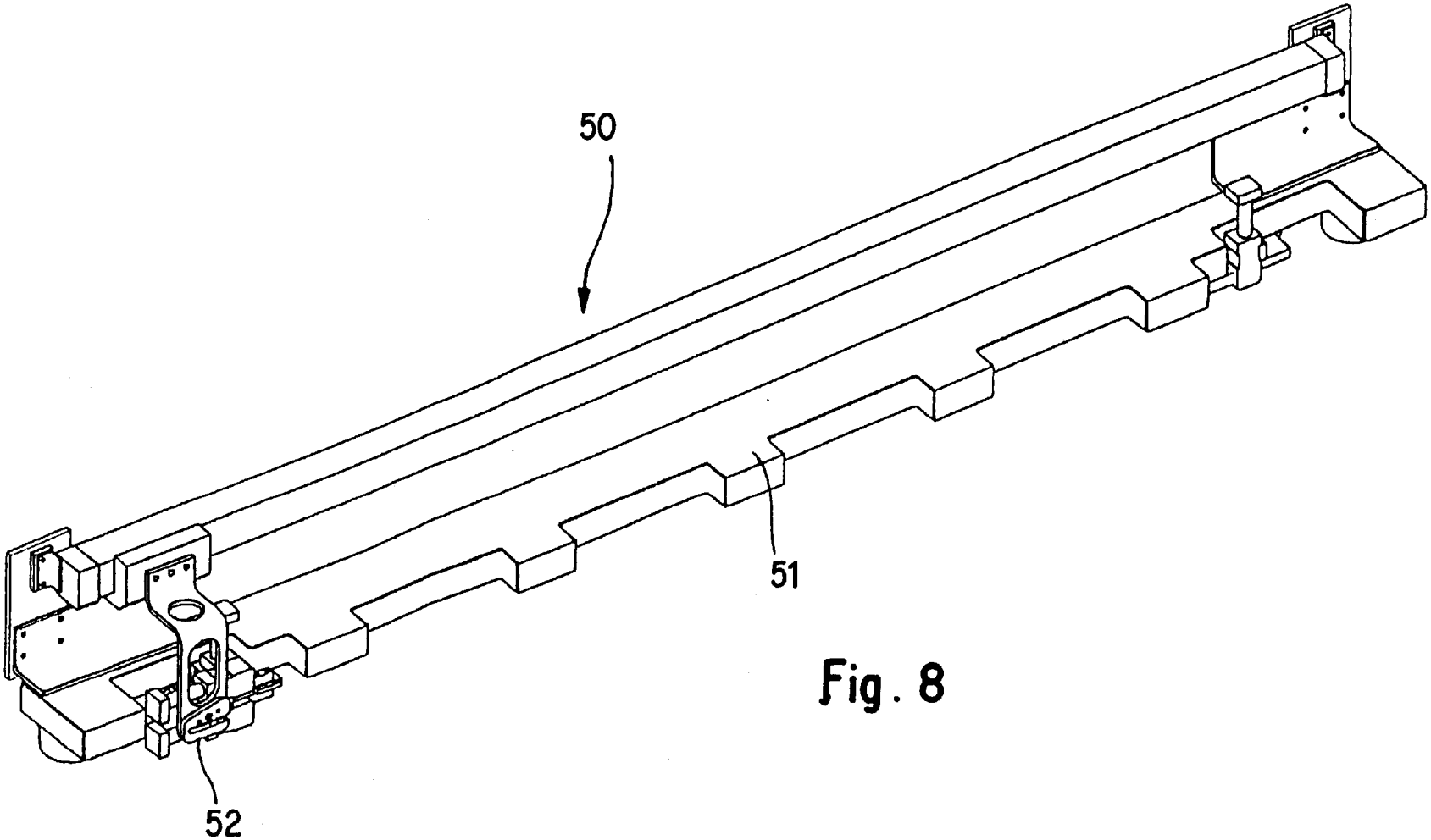
FIG. 8 is a cutting device used in the device according to the invention, in a perspective view.

As already described, during the lifting of the new film roll 15 into working position W, its end is secured to a locking tube 24. When a new roll 15 reaches the working position, the film stretched between film roll 15 and the locking tube abuts a suction and cutting device 50 located in the upper frame part (FIG. 8). This device for example has a comb-like suction strip 51 to which the stretched film on film roll 15 can be secured. It is also possible to hold the film in cyclic fashion by clamps on the suction strip 51 in order to prevent a film loss for example if the suction strip should not function. Then the film is separated from the film roll by a knife 52. The new film roll 15 is then secured in the working position and prepared for pulling film off the film roll. The knife 52 is guided for example by a piston-less cylinder, permitting a long knife life and an easy and simple knife replacement. During the cutoff process it is possible to hold the film by cutting clamps in addition.

According to the invention, a device is therefore provided for fully automatic film change. The old roll is ejected and the new roll inserted by a single (motorized) lifting movement. The device need be loaded with a new film roll only once during a shift, for example at the beginning of the shift. The device can be loaded at any time, independently of production. Since loading is performed by a carriage, the storage location can be selected freely. When the film rolls are replaced, there is only a very short interruption of the production process, if any. A cycle is extended only slightly if at all by the replacement of the film roll, since replacement can take place for example during a perforation time, a time when the film is applied to a motor vehicle, or during the remainder of the time spent handling film that has been pulled off. The modular design allows the device according to the invention to be adapted in simple fashion for different film widths. It is merely necessary to modify the transverse connecting parts to match the width of the film.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A device for automatically changing film rolls comprising:

a receptacle for holding a first film roll in a working position wherein said film roll is rotatable for pulling off and separating film from said film roll;

a pallet for holding a second film roll in a standby position;

a lifting device for lifting the pallet with the second film roll held therein, said pallet moving the film roll from the standby position into the working position; and a pivotable ejection flange mounted on the pallet to remove the first film roll from the working position as the pallet moves the second film roll into the working position.

2. The device according to claim 1 wherein the pallet comprises:

a receiving holder; and support rollers adapted for mounting in different receptacles of the receiving holder to accommodate insertion of different films with different film roll diameters into in the device without additional adjustments.

3. The device according to claim 1 further comprising means for securing the pallet on the lifting device.

4. The device according to claim 1 wherein the pallet is mountable on a carriage for movement into a frame of the devices whereby the second film roll located on the pallet is brought into the standby position.

5. The device according to claim 4 further comprising at least two centering pins for securing pallet on the carriage.

6. The device according to claim 1 further comprising a compensating roller which is movable into operating contact with first film roll, said roller being at least one of drivable and brakable.

7. The device according to claim 1 further comprising:

a measuring device which is movable into operating contact with first film roll, for measuring the film pulled off film roll;

wherein the measuring device generates a signal to a control device for triggering movement of second film roll.

8. The device according to claim 7 wherein said measuring device is a measuring wheel.

9. The device according to claim 1 further comprising a locking tube, which is movable into contact with one of the lifting device and the pallet, for securing a film end pulled off the second film roll.

10. The device according to claim 9 further comprising a suction strip for moving an end of the film on the second film roll secured to the locking tube, into a specific position relative to the working position.

11. The device according to claim 10 further comprising a cutting device for cutting the film between the locking tube and suction strip.

12. The device according to claim 1 wherein the receptacle for holding the first film roll in the working position includes conical receptacles that are adjustable axially against the film roll to hold it in the working position, and are movable away from it during or before a removal of film roll from the working position.

13. A method for automatically changing film rolls, comprising:

locating a first film roll in a working position wherein said film roll is rotatable for pulling off and separating film from said film roll;

locating a second film roll in a standby position;

measuring film pulled from said first roll in the working position, and generating a corresponding signal at a predetermined state of film removal;

when a corresponding signal is generated, moving said second film roll from the standby position to the working position;

moving an ejecting device in tandem with second film roll, movement of said ejecting device with said second film roll displacing said first film roll from said working position before said second film roll reaches the working position; and when the corresponding signal is generated, rewinding onto the first film roll film that has already been pulled off the first film roll and not yet separated, before or during movement of second film roll.

14. The method according to claim 13 wherein:

said second film roll is supported on a pallet in said standby position;

said step of moving said second film roll from the standby position to the working position comprises moving said pallet with said second film roll supported thereon;

said ejecting device is mounted on pallet and is moved with said pallet for displacing said first film roll.

15. A device for the automatic changing of film rolls, comprising:

a working position in which a first film roll is rotatably mounted centered between two movable receiving cones positioned axially opposite each other, with a free film end of the film being held in a defined position against a suction strip, so that the film is removable and separatable from the first film roll, wherein the receiving cones situated in the working position are movable axially against the film roll and, movable away from it removing the film roll from the working position;

a waiting position arranged below the working position, in which a second film roll is supported in a ready position on rotating support cylinders, with a free end of the second film roll attached to a positioning rod, said rotating support cylinders with the second film roll and the positioning rod being mounted on a pallet that is vertically movable by a lifting mechanism from the waiting position into the working position and movable back into the waiting position;

a swinging ejection strap mounted on the pallet and able to be lifted and lowered for ejecting the first film roll, by means of which, during lifting movement of the second film roll, the first film roll released by the receiving cones is vertically movable out of the working position for dropping into a core receptacle also situated on the pallet;

wherein the beginning of the film of the second film roll, attached to the positioning rod, is deliverable to the suction strip in the working position after lifting of the second film roll into the working position and the coil core of the second film roll can be taken over by the receiving cones.

16. A process for automatic dispensing and changing of film rolls, comprising:

receiving a first film roll in a working position centered between receiving cones that are movable in controlled manner and situated axially opposite each other;

holding a free film end of the first film roll in a defined position against a suction strip;

pulling off and separating film from the first film roll;

providing a second film roll, resting on rotating support cylinders, in a waiting position situated below the working position; and attaching a free film end of the second film roll to a positioning rod on a vertically movable pallet;

lifting the pallet with the second film roll into the working position while simultaneously releasing the centering of the first film roll;

dropping the first film roll via a swinging ejection strap into a receptacle situated on the pallet;

delivering the end of the second film roll from the positioning rod of the palette to the suction strip of the working position; and the receiving cones taking over a coil core of the second film roll after the second film roll is lifted into the working position.

17. The process according to claim 16, wherein a roll change is triggered automatically at the occurrence of a corresponding signal generated by measuring means that work together with the first film roll.

* * * * *